US011600455B2

(12) United States Patent
Hou et al.

(10) Patent No.: US 11,600,455 B2
(45) Date of Patent: Mar. 7, 2023

(54) KEYSWITCH

(71) Applicant: DARFON ELECTRONICS CORP., Taoyuan (TW)

(72) Inventors: Po-Chun Hou, Taoyuan (TW); Chin-Hung Lin, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 17/577,767

(22) Filed: Jan. 18, 2022

(65) Prior Publication Data

US 2022/0262580 A1 Aug. 18, 2022

(30) Foreign Application Priority Data

Feb. 18, 2021 (TW) ..... 110105532

(51) Int. Cl.
*H01H 3/12* (2006.01)
*H01H 13/704* (2006.01)
*H01H 9/02* (2006.01)

(52) U.S. Cl.
CPC ..... *H01H 3/125* (2013.01); *H01H 9/02* (2013.01); *H01H 13/704* (2013.01); *H01H 2009/0278* (2013.01); *H01H 2233/07* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 10,032,575 | B2 | 7/2018 | Chen | |
| 10,586,662 | B2 | 3/2020 | Wu et al. | |
| 10,910,175 | B2 | 2/2021 | Huang et al. | |
| 2018/0040438 | A1* | 2/2018 | Chen | H01H 3/125 |
| 2022/0044888 | A1* | 2/2022 | Yen | H01H 3/125 |

FOREIGN PATENT DOCUMENTS

| | | | |
|---|---|---|---|
| CN | 204360974 | U | 5/2015 |
| TW | M411653 | U1 | 9/2011 |
| TW | 201705167 | A | 2/2017 |
| TW | I615871 | B | 2/2018 |
| TW | I653547 | B | 3/2019 |
| TW | 201944441 | A | 11/2019 |
| TW | 202101495 | A | 1/2021 |

* cited by examiner

*Primary Examiner* — Ahmed M Saeed
(74) *Attorney, Agent, or Firm* — Winston Hsu

(57) ABSTRACT

A keyswitch includes a base plate, a keycap, a balance bar, at least one buffer layer, and a membrane switch layer disposed on a base plate. A linking portion of the base plate protruding upward penetrates through the membrane switch layer such that a contact portion of the membrane switch layer is located proximate to the linking portion. A connecting section of the balance bar passes through a through hole of the linking portion. The at least one buffer layer is formed on a lower surface of the contact portion, and extends along a first lateral path and a second lateral path. The contact portion supports the connecting section to abut against a top wall of the linking portion. When the keycap moves upward and downwards, the connecting section pivotally slides on the contact portion, between the first lateral path and the second lateral path.

14 Claims, 11 Drawing Sheets

KEYSWITCH

CROSS-REFERENCE TO RELATED APPLICATION

This utility application claims priority to Taiwan Application Serial Number 110105532, filed Feb. 18, 2021, which is incorporated herein by reference.

BACKGROUND OF THE INVENTION

1. Field of the Invention

The invention relates to a keyswitch, and in particular, to a keyswitch including a balance bar and being capable of reducing noise during operation.

2. Description of the Prior Art

Keyboards have been common input peripheral devices of data processing apparatuses. The appearance of the operation surface of the keys on a general keyboard is mostly square. However, the operation surface of certain keys has a longer side, such as "ENTER", "SPACE BAR", "SHIFT" keys, etc. These special keys are generally called multiple keys.

When the user presses one end of the multiple key, the pressed end of the multiple key will drop. While the other end of the multiple key will not drop since the force is only applied to one end of the multiple key. Therefore, most of the multiple keys in the prior art are equipped with balance bars. As for the multiple key equipped with the balance bar of the prior art, the main bar body of the balance bar is pivotally engaged to the bottom surface of the keycap, and the connecting section of the balance bar passes through the connecting portion extending upward from the base plate of the multiple key. With the assistance of the balance bar, the keycap can maintain balance without tilting w % ben moving vertically relative to the base plate. In addition, the main bar body of the balance bar engaged to the bottom surface of the keycap is arranged along the transverse direction of the keycap, the strength of the keycap is increased by the attached main bar body.

However, in the prior art, when the user operates the keyboard, it causes noise that the connecting section of the balance bar hits the inner wall of the connecting portion.

SUMMARY OF THE INVENTION

Accordingly, one scope of the invention is to provide a keyswitch including a balance bar. The keyswitch according to the invention can absorb the impact energy of the balance bar during operation to eliminate noise, and can improve the tactile feeling of the user operating the keyswitch according to the invention.

A keyswitch according to a preferred embodiment of the invention includes a base plate, a membrane switch layer, a keycap, a balance bar, and at least one buffer layer. The base plate includes a main plate body and a linking portion protruding upward from the main plate body. The linking portion has a through hole, and includes a first sidewall protruding upward from the main plate body, a second sidewall protruding upward from the main plate body, and a top wall connecting between the first sidewall and the second sidewall. The linking portion defines a front side and a rear side opposite to the front side, a first lateral path and a second lateral path. The first lateral path extends from the first sidewall toward the front side of the linking portion. The second lateral path extends from the second sidewall toward the front side of the linking portion. The membrane switch layer has a breakout hole, and includes a contact portion. The membrane switch layer is disposed on the main plate body such that the linking portion penetrates through the breakout hole of the membrane switch layer, and that the contact portion of the membrane switch layer is located proximate to the linking portion at the front side. The keycap is disposed above the base plate, and is capable of moving vertically with respect to the base plate. The balance bar includes a main bar body and a connecting section. The connecting section has a free first end. The main bar body is rotatably engaged on a bottom surface of the keycap. The connecting section passes through the through hole of the linking portion, and the first end is located at the rear side of the linking portion. The contact portion supports the connecting section to abut against the top wall. The at least one buffer layer is formed on a lower surface of the contact portion, and extends at least along the first lateral path and the second lateral path. A membrane elasticity coefficient of the contact portion is less than a buffer elasticity coefficient of the at least one buffer layer. The impact energy of the connecting section and the linking portion is mainly absorbed by the at least one buffer layer.

In one embodiment, a first friction coefficient of the contact portion is less than a second friction coefficient of the at least one buffer layer.

In one embodiment, the membrane switch layer includes an upper circuit membrane, a spacer layer and a lower circuit membrane. The spacer layer is disposed between the upper circuit membrane and the lower circuit membrane. The upper circuit membrane and the spacer layer are removed at the contact portion of the membrane switch layer.

In one embodiment, the connecting section also has a second end. The main bar body has a third end. The balance bar also includes an engaging section connected between the second end of the connecting section and the third end of the main bar body.

In another embodiment, the connecting section also has a second end. The main bar body has a third end. The second end of the connecting section is connected to the third end of the main bar body.

In one embodiment, the at least one buffer layer is formed to cover at least the whole of the lower surface of the contact portion.

Further, the keyswitch according to the preferred embodiment of the invention also includes a lifting mechanism. The lifting mechanism is disposed between the base plate and the keycap. The lifting mechanism restricts the keycap to move between an unpressed position and a pressed position.

Further, the keyswitch according to the preferred embodiment of the invention also includes a resilient actuating device. The membrane switch layer also includes a switch disposed below the keycap. The resilient actuating device is disposed between the keycap and the base plate, and located above the switch. When the keycap is pressed to move to the pressed position, the resilient actuating device is deformed to turn on the switch. When the keycap is released, the resilient actuating device provides a restoring force required for the keycap to return to the unpressed position, and the switch is turned off.

Compared to the prior art, the keyswitch according to the invention can absorb the impact energy of the balance bar during operation to eliminate noise, and can improve the tactile feeling of the user operating the keyswitch according to the invention.

The advantage and spirit of the invention may be understood by the following recitations together with the appended drawings.

BRIEF DESCRIPTION OF THE APPENDED DRAWINGS

DETAILED DESCRIPTION OF THE INVENTION

In order to eliminate the noise generated by the connecting section of the balance bar hitting the inner wall of the through hole of the linking portion, the invention discloses that cushioning materials are introduced in the following embodiments. First of all, as the keycap moves vertically with respect to the base plate, the connecting section of the balance bar will not only rotate in the linking portion of the base plate, but also slide laterally therebetween. Therefore, the configuration of cushioning materials must avoid affecting the smooth sliding of the connecting section of the balance bar in the linking portion of the base plate. The smooth sliding of the connecting section of the balance bar in the linking portion of the base plate can ensure that the keycap can move up and down smoothly. Secondly, if a part or all of the cushioning material is constituted by a sheet material (for example, the tongue formed by the extension of the membrane switch layer), this solution that violates the device stacking order is not conducive to the automated assembly line. Additional processes or assembling fixtures will cause unnecessary costs for this solution. Furthermore, although the smooth surface of the membrane switch layer can allow the balance bar to slide smoothly, the membrane switch layer itself has limited cushioning effect regardless of whether it is suspended or thinned. It is difficult for the suspended or thinned membrane switch layer to absorb the impact energy of the balance bar.

Figure 1:
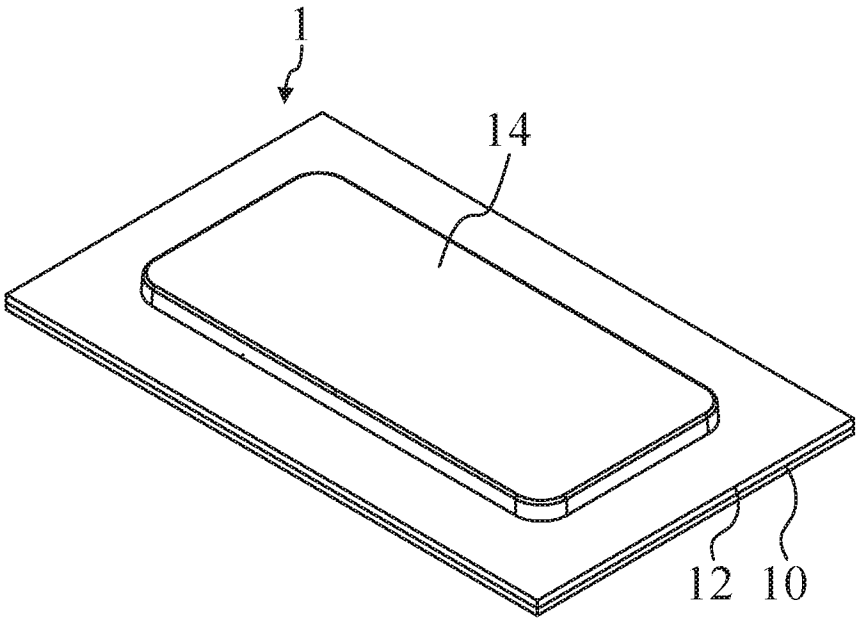
FIG. 1 is a perspective view of a keyswitch according to a first preferred embodiment of the invention.
Figure 2:
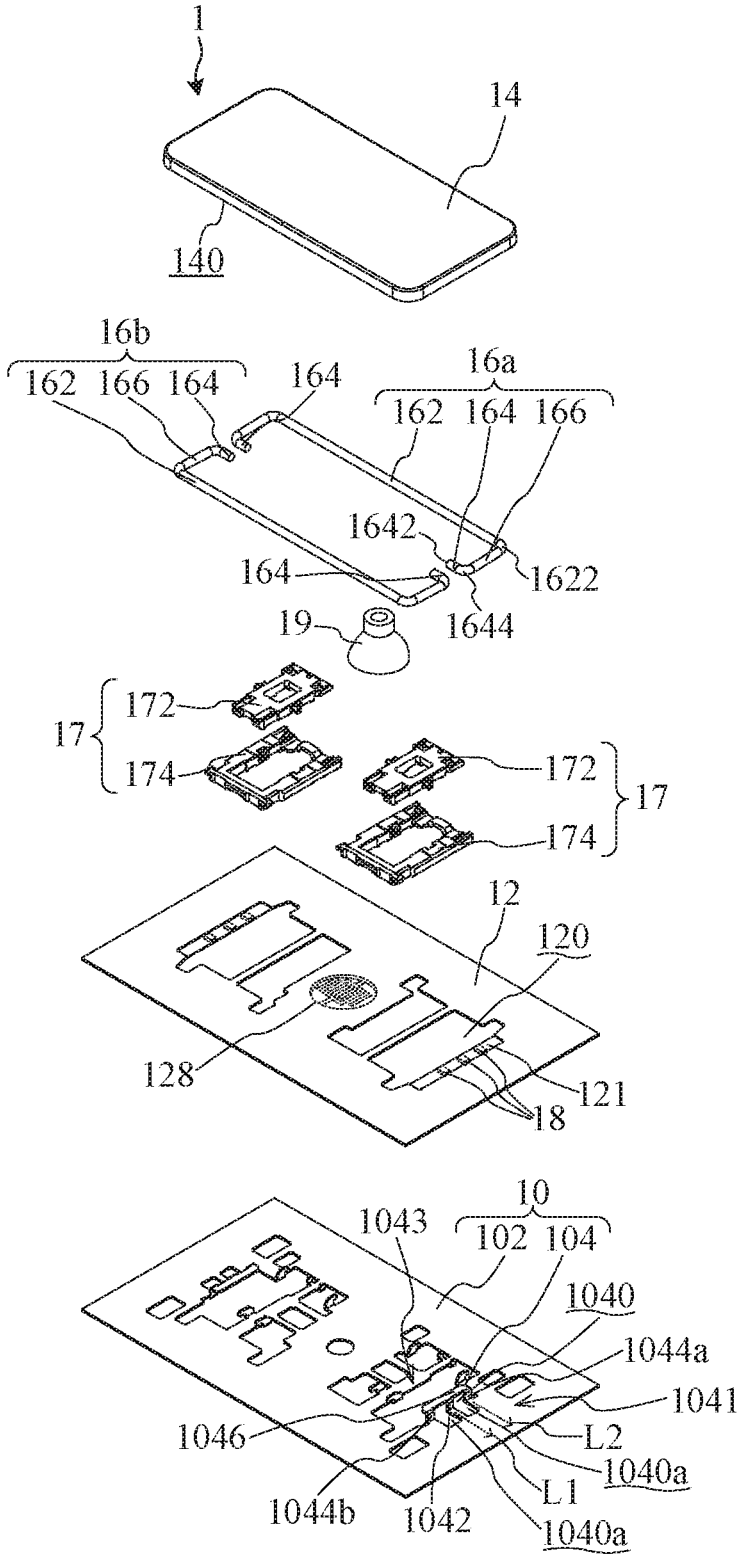
FIG. 2 is an explosive view of the devices and members of the keyswitch according to the first preferred embodiment of the invention.
Figure 3:
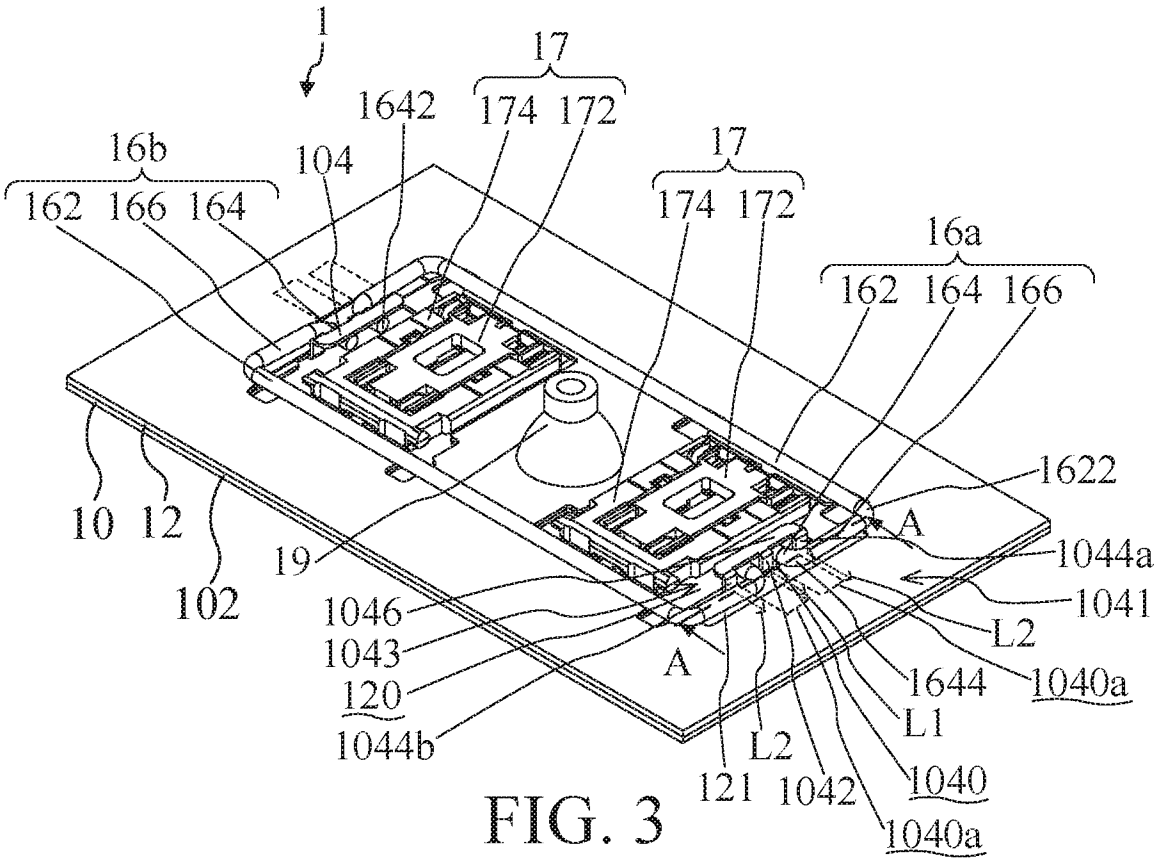
FIG. 3 is a perspective view of the keyswitch according to the first preferred embodiment of the invention with the keycap removed.
Figure 4:
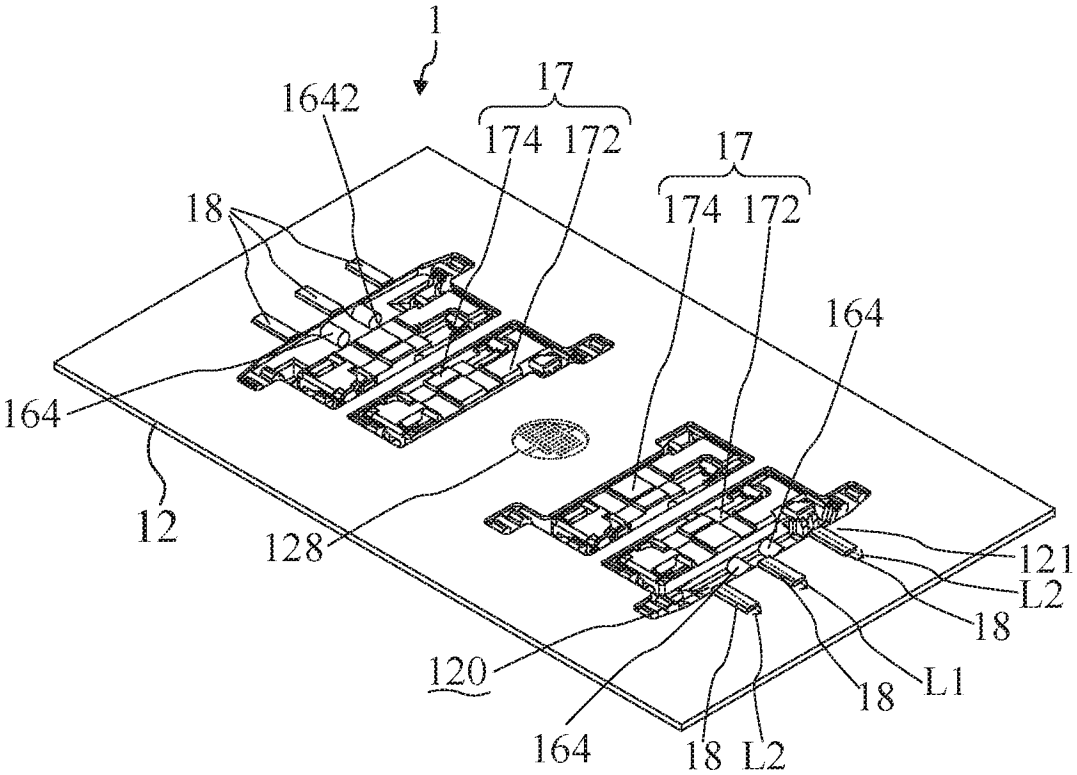
FIG. 4 is a bottom view of the keyswitch according to the first preferred embodiment of the invention with the base plate removed.
Figure 5:
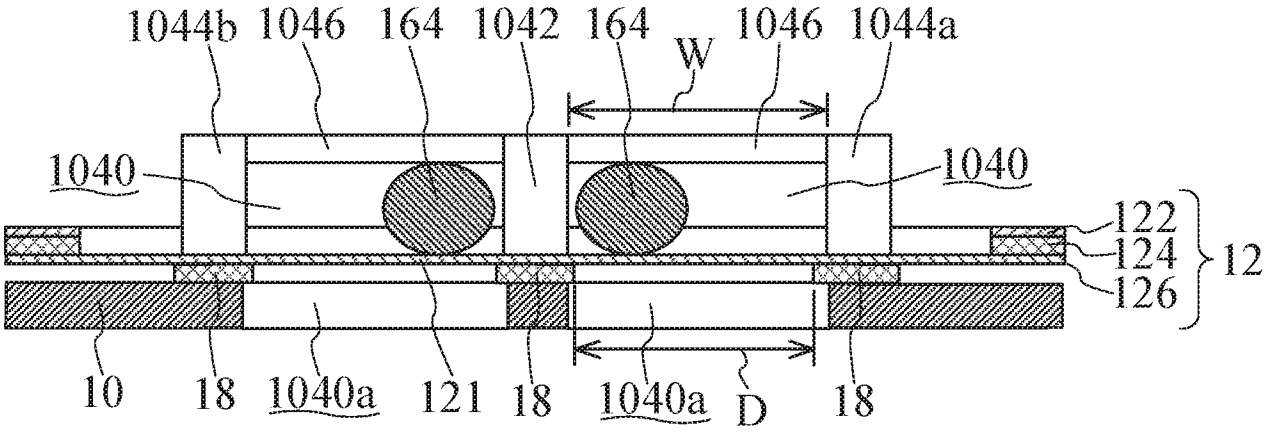
FIG. 5 is a partial cross-sectional view of the keyswitch according to the first preferred embodiment of the invention in FIG. 3 along the line A-A.

Referring to FIG. 1 to FIG. 5, those drawings schematically illustrate a keyswitch 1 according to the first preferred embodiment of the invention. FIG. 1 schematically illustrates with a perspective view the keyswitch 1 according to the first preferred embodiment of the invention. FIG. 2 is an explosive view of the devices and members of the keyswitch 1 according to the first preferred embodiment of the invention. FIG. 3 schematically illustrates with a perspective view of the keyswitch 1 according to the first preferred embodiment of the invention with a keycap 14 removed. FIG. 4 schematically illustrates with a bottom view of the keyswitch 1 according to the first preferred embodiment of the invention with a base plate 10 removed. FIG. 5 is a partial cross-sectional view of the keyswitch 1 in FIG. 3 along the line A-A.

As shown in FIG. 1. FIG. 2, FIG. 3 and FIG. 4, the keyswitch 1 according to the first preferred embodiment of the invention includes the base plate 10, a membrane switch layer 12, the keycap 14, two balance bars (16*a*, 16*b*), and at least one buffer layer 18.

The base plate 10 includes a main plate body 102 and a linking portion 104 protruding upward from the main plate body 102. The linking portion 104 has a through hole 1040, and includes a first sidewall 1042 protruding upward from the main plate body 102, second sidewalls (1044*a*, 1044*b*) protruding upward from the main plate body 102, and a top wall 1046 connecting between the first sidewall 1042 and the second sidewalls (1044*a*, 1044*b*). The linking portion 104 defines a front side 1041 and a rear side 1043 opposite to the front side 1041, a first lateral path L1 and two second lateral paths L2. The first lateral path L1 extends from the first sidewall 1042 toward the front side 1041 of the linking portion 104. The second lateral paths L2 extend from the second sidewalls (1044*a*, 1044*b*) toward the front side 1041 of the linking portion 104.

The first sidewall 1042, the second sidewall (1044*a* or 1044*b*) and the top wall 1046 jointly define the through hole 1040. The normal direction of the through hole 1040 is parallel to the plane direction of the base plate 10 and the main plate body 102. If it is necessary, the through hole 1040 also communicates with an extension hole 1040*a* formed on the main plate body 102. The extension hole 1040*a* is approximately perpendicular to the through hole 1040, and extends along the normal direction of the through hole 1040. That is to say, the first lateral path L1 and each second lateral path L2 respectively extend forward from two sides of the through hole 1040 and are parallel to the normal direction of the through hole 1040. In one embodiment, the first lateral path L1 and the second lateral paths L2 correspond to the first sidewall 1042 and the second sidewall (1044*a*. 1044*b*), respectively, and the individual lengths of the first lateral path L1 and the second lateral paths L2 can correspond to the length of the extension hole 1040*a*.

The membrane switch layer 12 has a breakout hole 120, and includes a contact portion 121. The membrane switch layer 12 is disposed on the main plate body 102 such that the linking portion 104 penetrates through the breakout hole 120 of the membrane switch layer 12. The contact portion 121 can be a single-layer or multi-layer membrane, and is an area defined by the linking portion 104 of the base plate 10, the first lateral path L1 and one of the second lateral paths L2, that is, adjacent to the linking portion 104 and located at the front side 1041 of the linking portion 104.

The keycap 14 is disposed above the base plate 10, and is capable of moving vertically with respect to the base plate 10.

Each of the balance bars (16*a*, 16*b*) includes a main bar body 162 and a connecting section 164. The connecting section 164 has a free first end 1642. The main bar body 162 is rotatably engaged on a bottom surface 140 of the keycap 14. The connecting section 164 passes through the through hole 1040 of the linking portion 104, and the first end 1642 is located at the rear side 1043 of the linking portion 104. The main bar bodies 162 of the balance bars (16*a*, 16*b*) are engaged on the bottom surface 140 of the keycap 14 along the transverse direction of the keycap 14.

In one embodiment, as shown in FIG. 2 and FIG. 3, the connecting section 164 of each of the balance bars (16*a*, 16*b*) also has a second end 1644. The main bar body 162 has a third end 1622. Each of the balance bars (16*a*, 16*b*) also includes an engaging section 166 connected between the second end 1644 of the connecting section 164 and the third end 1622 of the main bar body 162. In this example shown in FIG. 2 and FIG. 3, the appearance of each of the balance bars (16*a*, 16*b*) is roughly C-shaped. It should be emphasized that the keyswitch 1 according to the invention can also include only the balance bar 16*a* without the need of the balance bar 16*b*, as required.

The contact portion 121 of the membrane switch layer 12 supports the connecting section 164 to abut against the top wall 1046 of the linking portion 104. The at least one buffer layer 18 is formed on a lower surface 1210 of the contact portion 121, and extends at least along the first lateral path L1 and the second lateral paths L2. In particular, a membrane elasticity coefficient of the contact portion 121 is less than a buffer elasticity coefficient of the at least one buffer layer 18. Thereby, the impact energy of the connecting section 164 caused by the downward movement of the keycap 14 is absorbed by the at least one buffer layer 18. As shown in FIG. 4 and FIG. 5, the at least one buffer layer 18 is formed on the lower surface 1210 of the contact portion 121, and extends at least along the first lateral path L1 and the second lateral paths L2. In this example as shown in FIG. 4 and FIG. 5, the connecting sections 164 of the two balance bars (16*a*, 16*b*) are arranged side by side, so that the first sidewall 1042 is disposed between two second sidewalls 1044.

When the keycap 14 moves up and down, the connecting section 164 of each of the balance bar (16*a*, 16*b*) slides rotatably on the contact portion 121 of the membrane switch layer 12 and between the first lateral path L1 and one of the second lateral paths L2. In FIG. 5, in order to avoid excessive sliding of the connecting sections 164 of the balance bars (16*a*, 16*b*) to knock the first sidewall 1042 or the second sidewalls (1044*a*, 1044*b*), the distance between the two adjacent buffer layers 18, defined as a buffer layer gap D, can be less than a through hole width W of the through hole 1040. So that when the connecting section 164 of each of the balance bars (16*a*, 16*b*) sliding on the contact portion 121 of the membrane switch layer 12 closes to the first side wall 1042 or the second side wall 1044*a*/1044*b*, the connecting section 164 of each of the balance bars (16*a*, 16*b*) slows down due to the greater resistance of the buffer layers 18 pressing upward.

In one embodiment, the at least one buffer layer 18 can be formed of ultraviolet curable resin, hydrogel, silica gel, or other commercial polymer materials with high elastic coefficients. The buffer layers 18 located at the first lateral path L1 and the second lateral path L2 can be integrally formed. For example, the buffer layers 18 are arranged along three sides of the extension hole 1040*a* to surround the extension hole 1040*a*. Either, just as in the foregoing embodiment, the buffer layers 18, the first lateral path L1 and the second lateral path L2 are located at two sides of the extension hole 1040*a*.

In one embodiment, a first friction coefficient of the contact portion 121 is less than a second friction coefficient of the at least one buffer layer 18. Thereby, as the keycap 14 moves vertically with respect to the base plate 10, the connecting section 164 of each of the balance bars (16*a*, 16*b*) slides smoothly on the upper surface 1212 of the contact portion 121. Therefore, the keyswitch 1 according to the invention will not affect the user's tactile feeling in operation.

In one embodiment, as shown in FIG. 5, the membrane switch layer 12 includes an upper circuit membrane 122, a spacer layer 124 and a lower circuit membrane 126. The spacer layer 124 is disposed between the upper circuit membrane 122 and the lower circuit membrane 126. The upper circuit membrane 122 and the spacer layer 124 are removed at the contact portion 121 of the membrane switch layer 12. In other embodiments, the contact portion 121 of the membrane switch layer 12 can be several layers or any one of the upper circuit membrane 122, the spacer layer 124, and the lower circuit membrane 126.

In one embodiment, the upper circuit membrane 122, the spacer layer 124 and the lower circuit membrane 126 may be made of polyethylene terephthalate (PET), polyurethane (PU), polyimide (PI), poly (methyl methacrylate) (PMMA), methyl methacrylate (MMA), polycarbonate (PC), or other similar commercial polymer materials.

Figure 6:
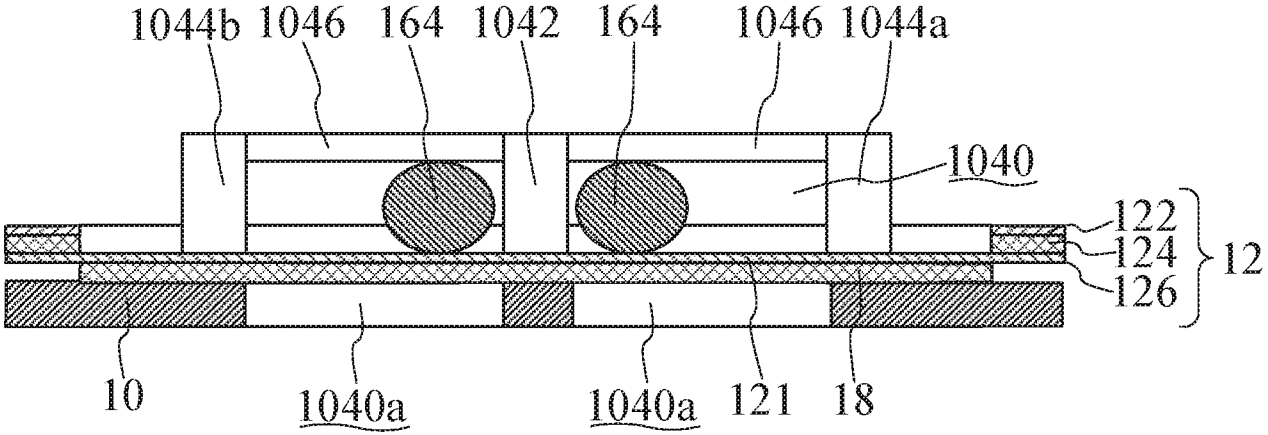
FIG. 6 is a partial cross-sectional view of a modification of the keyswitch according to the first preferred embodiment of the invention in FIG. 3 along the line A-A.

Referring to FIG. 6, FIG. 6 is a partial cross-sectional view of a modification of the keyswitch 1 according to the first preferred embodiment of the invention similarly in FIG. 3 along the line A-A. As shown in FIG. 6, in the modification, the at least one buffer layer 18 is formed to cover at least the whole of the lower surface 1210 of the contact portion 121.

Further, also shown in FIG. 2 and FIG. 3, the keyswitch 1 according to the first preferred embodiment of the invention also includes two lifting mechanisms 17. Each lifting mechanism 17 is disposed between the base plate 10 and the keycap 14. The two lifting mechanisms 17 restrict the keycap 14 to move between an unpressed position and a pressed position. The keyswitch 1 according to the first preferred embodiment of the invention can also include only one lifting mechanism 17.

In the example shown in FIGS. 2 and 3, each lifting mechanism 17 is a scissors-type lifting mechanism 17 composed of an inner support arm member 172 and an outer support arm member 174. The inner support arm member 172 is rotatably engaged to the bottom surface 140 of the keycap 14 and the base plate 10 respectively. The outer support arm member 174 is rotatably engaged to the bottom surface 140 of the keycap 14 and the base plate 10 respectively.

Further, also as shown in FIG. 2 and FIG. 3, the keyswitch 1 according to the first preferred embodiment of the invention also includes a resilient actuating device 19. The membrane switch layer 12 also includes a switch 128 disposed below the keycap 14. The resilient actuating device 19 is disposed between the keycap 14 and the base plate 10, and located above the switch 128. When the keycap 14 is pressed to move to the pressed position, the resilient actuating device 19 is deformed to trigger the switch 128. When the keycap 14 is released, the resilient actuating device 19 provides a restoring force required for the keycap 14 to return to the unpressed position, and the switch 128 is released. In the example shown in FIG. 3, the resilient actuating device 19 is disposed between the two lifting mechanisms 17.

Figure 7:
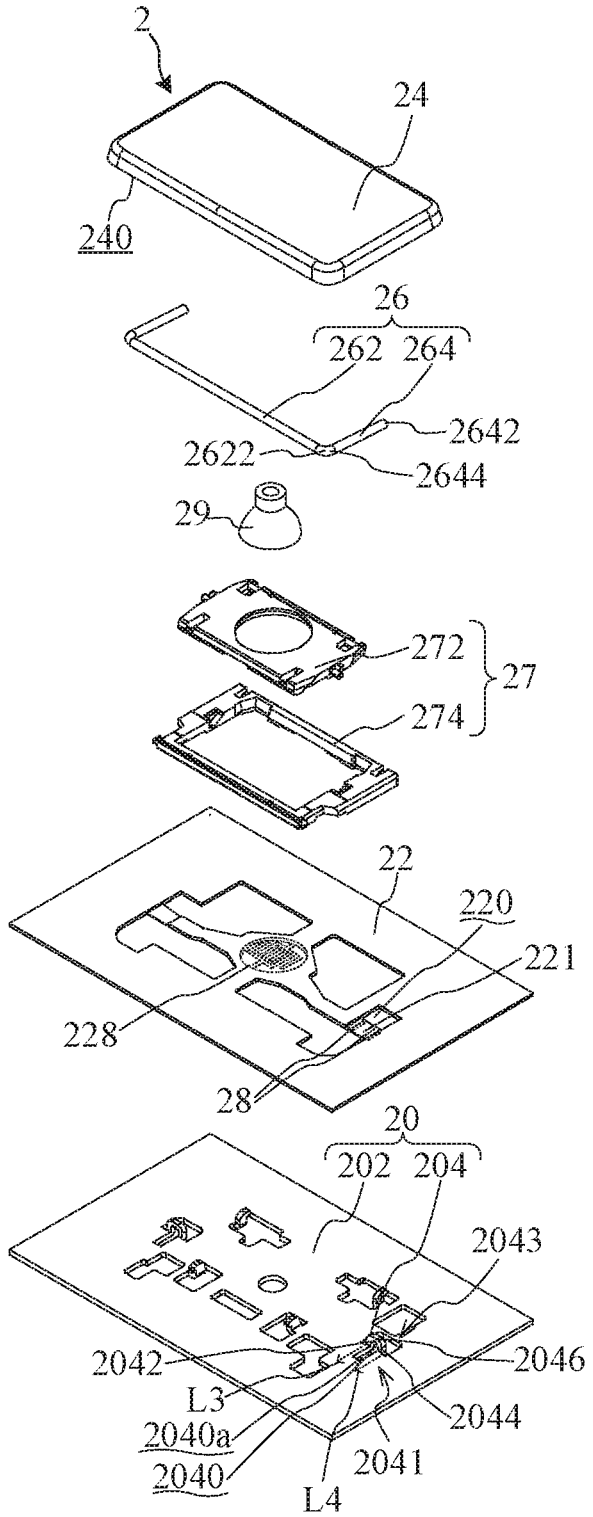
FIG. 7 is an explosive view of the devices and members of the keyswitch according to a second preferred embodiment of the invention.
Figure 8:
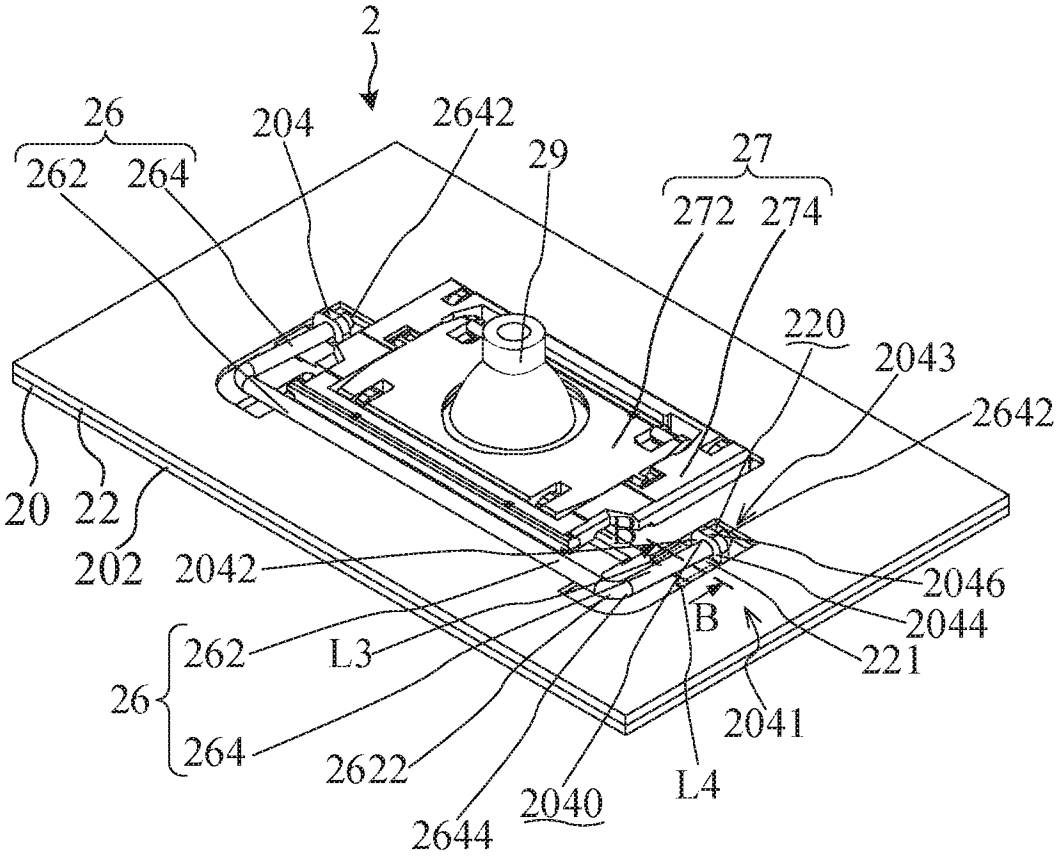
FIG. 8 is a perspective view of the keyswitch according to the second preferred embodiment of the invention with the keycap removed.
Figure 9:
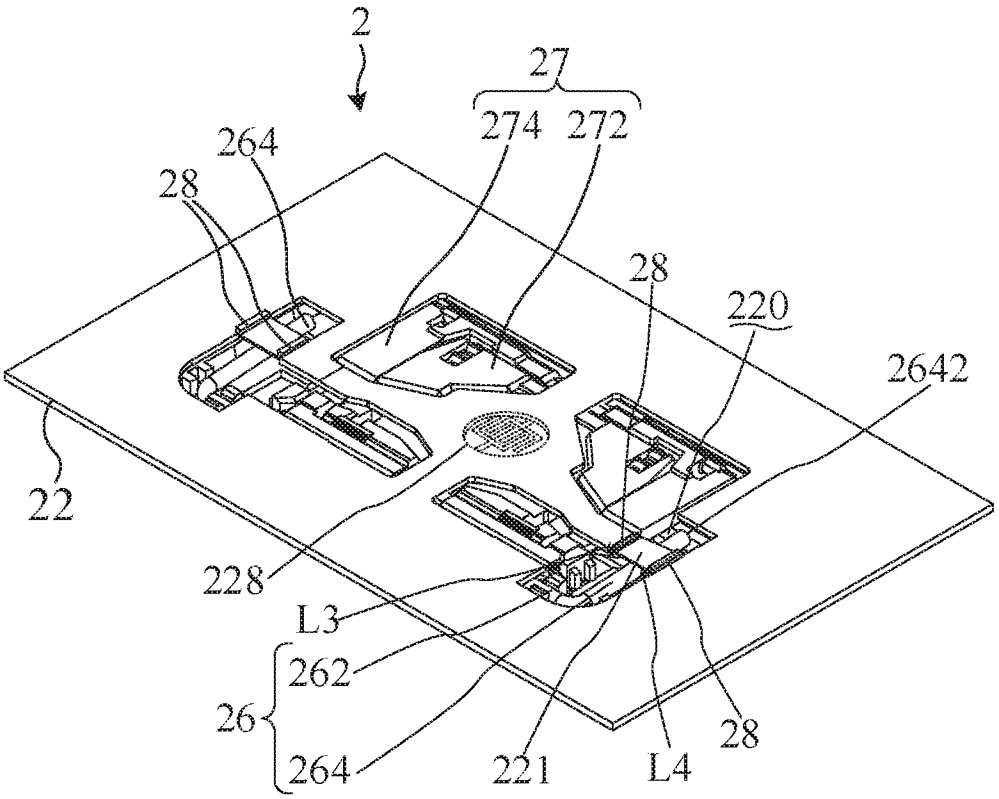
FIG. 9 is a bottom view of the keyswitch according to the second preferred embodiment of the invention with the base plate removed.
Figure 10:
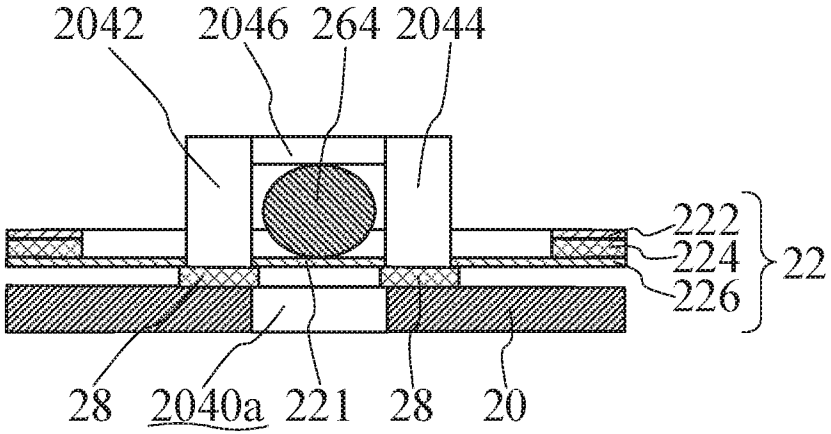
FIG. 10 is a partial cross-sectional view of the keyswitch according to the second preferred embodiment of the invention in FIG. 8 along the line B-B.

Referring to FIG. 7, FIG. 8, FIG. 9 and FIG. 10, those drawings schematically illustrate a keyswitch 2 according to the second preferred embodiment of the invention. FIG. 7 is an explosive view of the devices and members of the keyswitch 2 according to the second preferred embodiment of the invention. FIG. 8 schematically illustrates with a perspective view of the keyswitch 2 according to the second preferred embodiment of the invention with a keycap 24 removed. FIG. 9 schematically illustrates with a bottom view of the keyswitch 2 according to the second preferred embodiment of the invention with a base plate 20 removed. FIG. 10 is a partial cross-sectional view of the keyswitch 2 in FIG. 8 along the line B-B.

As shown in FIG. 7, FIG. 8 and FIG. 9, the keyswitch 2 according to the second preferred embodiment of the invention includes the base plate 20, a membrane switch layer 22, the keycap 24, a balance bar 26, and at least one buffer layer 28.

The base plate 20 includes a main plate body 202 and a linking portion 204 protruding upward from the main plate body 202. The linking portion 204 has a through hole 2040, and includes a first sidewall 2042 protruding upward from the main plate body 202, a second sidewall 2044 protruding upward from the main plate body 202, and a top wall 2046 connecting between the first sidewall 2042 and the second sidewall 2044. The linking portion 204 defines a front side 2041 and a rear side 2043 opposite to the front side 2041, a third lateral path L3 and a fourth lateral path L4. The third lateral path L3 extends from the first sidewall 2042 toward the front side 2041 of the linking portion 204. The fourth lateral path L4 extends from the second sidewall 2044 toward the front side 2041 of the linking portion 204.

The first sidewall 2042, the second sidewall 2044 and the top wall 2046 jointly define the through hole 2040. The normal direction of the through hole 2040 is parallel to the plane direction of the base plate 20 and the main plate body 202. If it is necessary, the through hole 2040 also communicates with an extension hole 2040*a* formed on the main plate body 202 of the base plate 20. The extension hole 2040*a* is approximately perpendicular to the through hole 2040, and extends along the normal direction of the through hole 2040. That is to say, the third lateral path L3 and the fourth lateral path L4 respectively extend forward from two sides of the through hole 2040 and are parallel to the normal direction of the through hole 2040. In one embodiment, the third lateral path L3 and the fourth lateral path L4 correspond to the first sidewall 2042 and the second sidewall 2044, respectively, and the individual lengths of the third lateral path L3 and the fourth lateral path L4 can correspond to the length of the extension hole 2040*a*.

The membrane switch layer 22 has a breakout hole 220, and includes a contact portion 221. The membrane switch layer 22 is disposed on the main plate body 202 such that the linking portion 204 penetrates through the breakout hole 220 of the membrane switch layer 22. The contact portion 221 is adjacent to the linking portion 204 and located at the front side 2041 of the linking portion 204.

The keycap 24 is disposed above the base plate 20, and is capable of moving vertically with respect to the base plate 20.

The balance bar 26 includes a main bar body 262 and a connecting section 264. The connecting section 264 has a free first end 2642. The main bar body 262 is rotatably engaged on a bottom surface 240 of the keycap 24. The connecting section 264 passes through the through hole 2040 of the linking portion 204, and the first end 2642 of the connecting section 264 is located at the rear side 2043 of the linking portion 204. The main bar body 262 of the balance bar 26 are engaged on the bottom surface 240 of the keycap 24 along the transverse direction of the keycap 24, and can increase the strength of the keycap 24.

In one embodiment, as shown in FIG. 7 and FIG. 8, the connecting section 264 of the balance bar 26 also has a second end 2644. The main bar body 262 has a third end 2622. The second end 2644 of the connecting section 264 is connected to the third end 2622 of the main bar body 262. In this example shown in FIG. 7 and FIG. 8, the appearance of the balance bar 26 is roughly U-shaped. It should be emphasized that the keyswitch 2 according to the invention can also include two balance bars 26 which are roughly U-shaped in appearance.

The contact portion 221 of the membrane switch layer 22 supports the connecting section 264 to abut against the top wall 2046 of the linking portion 204. The at least one buffer layer 18 is formed on a lower surface 2210 of the contact portion 221, and extends at least along the third lateral path L3 and the fourth lateral path L4. In particular, a membrane elasticity coefficient of the contact portion 221 is less than a buffer elasticity coefficient of the at least one buffer layer 28. Thereby, the impact energy of the connecting section 264 caused by the downward movement of the keycap 24 is absorbed by the at least one buffer layer 28. As shown in FIG. 9 and FIG. 10, the at least one buffer layer 28 is formed on the lower surface 2210 of the contact portion 221, and extend at least along the third lateral path L3 and the fourth lateral path L4.

In one embodiment, the at least one buffer layer 28 can be formed of ultraviolet curable resin, hydrogel, silica gel, or other commercial polymer materials with high elastic coefficients.

In one embodiment, a first friction coefficient of the contact portion 221 is less than a second friction coefficient of the at least one buffer layer 28. Thereby, as the keycap 24 moves vertically with respect to the base plate 20, the connecting section 264 of the balance bar 26 slides smoothly on the upper surface 2212 of the contact portion 221. Therefore, the keyswitch 2 according to the invention will not affect the user's tactile feeling in operation.

In one embodiment, as shown in FIG. 10, the membrane switch layer 22 includes an upper circuit membrane 222, a spacer layer 224 and a lower circuit membrane 226. The spacer layer 224 is disposed between the upper circuit membrane 222 and the lower circuit membrane 226. The upper circuit membrane 222 and the spacer layer 224 are removed at the contact portion 221 of the membrane switch layer 22.

In one embodiment, the upper circuit membrane 222, the spacer layer 224 and the lower circuit membrane 226 may be made of polyethylene terephthalate (PET), polyurethane (PU), polyimide (PI), poly (methyl methacrylate) (PMMA), methyl methacrylate (MMA), polycarbonate (PC), or other similar commercial polymer materials.

Figure 11:
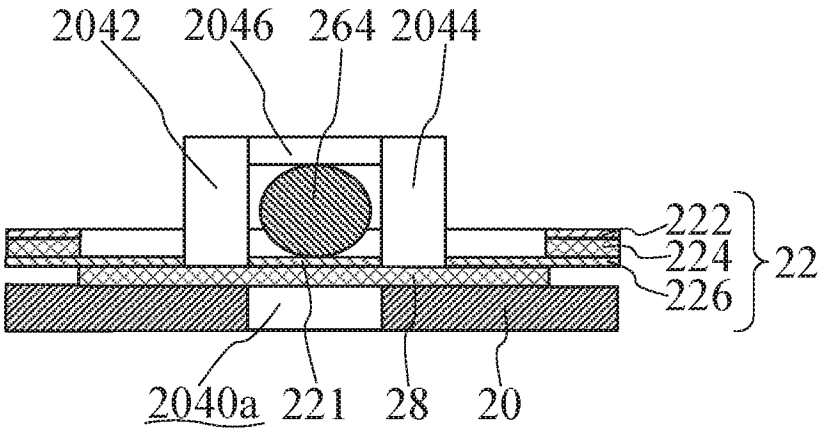
FIG. 11 is a partial cross-sectional view of a modification of the keyswitch according to the second preferred embodiment of the invention in FIG. 8 along the line B-B.

Referring to FIG. 11, FIG. 11 is a partial cross-sectional view of a modification of the keyswitch 2 according to the second preferred embodiment of the invention similarly in FIG. 8 along the line B-B. As shown in FIG. 11, in the modification, the at least one buffer layer 28 is formed to cover at least the whole of the lower surface 2210 of the contact portion 221.

Further, also shown in FIG. 7 and FIG. 8, the keyswitch 2 according to the second preferred embodiment of the invention also includes a lifting mechanism 27. The lifting mechanism 27 is disposed between the base plate 20 and the keycap 24. The lifting mechanism 27 restrict the keycap 24 to move between an unpressed position and a pressed position. In the example shown in FIGS. 7 and 8, the lifting mechanism 27 is a scissors-type lifting mechanism 27 composed of an inner support arm member 272 and an outer support arm member 274. The inner support arm member 272 is rotatably engaged to the bottom surface 240 of the keycap 24 and the base plate 20 respectively. The outer support arm member 274 is rotatably engaged to the bottom surface 240 of the keycap 24 and the base plate 20 respectively.

Further, also as shown in FIG. 7 and FIG. 8, the keyswitch 2 according to the second preferred embodiment of the invention also includes a resilient actuating device 29. The membrane switch layer 22 also includes a switch 228 disposed below the keycap 24. The resilient actuating device 29 is disposed between the keycap 24 and the base plate 20, and located above the switch 228. When the keycap 24 is pressed to move to the pressed position, the resilient actuating device 29 is deformed to trigger the switch 228. When the keycap 24 is released, the resilient actuating device 29 provides a restoring force required for the keycap 24 to return to the unpressed position, and the switch 228 is released.

With the detailed description of the above preferred embodiments of the invention, it is clear to understand that the keyswitch according to the invention can absorb the impact energy of the balance bar during operation to eliminate noise, and can improve the tactile feeling of the user operating the keyswitch according to the invention.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A keyswitch, comprising:

a base plate, comprising a main plate body and a linking portion protruding upward from the main plate body, the linking portion having a through hole and comprising a first sidewall protruding upward from the main plate body, a second sidewall protruding upwards from the main plate body, and a top wall connecting between the first sidewall and the second sidewall, the linking portion defining a front side and a rear side opposite to the front side, a first lateral path and a second lateral path, the first lateral path extending from the first sidewall toward the front side, the second lateral path extending from the second sidewall toward the front side;

a membrane switch layer, having a breakout hole and comprising a contact portion, an upper circuit membrane, a spacer layer and a lower circuit membrane, the spacer layer being disposed between the upper circuit membrane and the lower circuit membrane, the membrane switch layer being disposed on the main plate body such that the linking portion penetrates through the breakout hole, and that the contact portion is located proximate to the linking portion at the front side, and the upper circuit membrane and the spacer layer being removed at the contact portion of the membrane switch layer;

a keycap, being disposed above the base plate and capable of moving vertically with respect to the base plate;

a balance bar, comprising a main bar body and a connecting section, the connecting section having a free first end, the main bar body being rotatably engaged on a bottom surface of the keycap, the connecting section passing through the through hole, and the first end being located at the rear side, wherein the contact portion supports the connecting section to abut against the top wall; and at least one buffer layer, being formed to cover at least the whole of a lower surface of the contact portion and extending at least along the first lateral path and the second lateral path, wherein a membrane elasticity coefficient of the contact portion is less than a buffer elasticity coefficient of the at least one buffer layer.

2. The keyswitch of claim 1, wherein a first friction coefficient of the contact portion is less than a second friction coefficient of the at least one buffer layer.

3. The keyswitch of claim 1, wherein the connecting section also has a second end, the main bar body has a third end, the balance bar also comprises an engaging section connected between the second end of the connecting section and the third end of the main bar body.

4. The keyswitch of claim 1, wherein the connecting section also has a second end, the main bar body has a third end, the second end of the connecting section is connected to the third end of the main bar body.

5. The keyswitch of claim 1, further comprising:

a lifting mechanism, disposed between the base plate and the keycap, the lifting mechanism restricting the keycap to move between an unpressed position and a pressed position.

6. The keyswitch of claim 5, wherein the membrane switch layer also comprises a switch disposed below the keycap, the keyswitch further comprises:

a resilient actuating device, disposed between the keycap and the base plate and located above the switch, wherein when the keycap is pressed to move to the pressed position, the resilient actuating device is deformed to turn on the switch, when the keycap is released, the resilient actuating device provides a restoring force required for the keycap to return to the unpressed position, and the switch is turned off.

7. A keyswitch, comprising:

a base plate, comprising a linking portion protruding upward, the linking portion having a through hole, two sides of the through hole respectively a first lateral path and a second lateral path which both extend in a normal direction of the through hole;

a keycap, being disposed above the base plate and capable of moving vertically with respect to the base plate;

a membrane switch layer, being disposed on the base plate and comprising an upper circuit membrane, a spacer layer, a lower circuit membrane, and a contact portion located between the first lateral path and the second lateral path and located proximate to the linking portion of the base plate, the spacer layer being disposed between the upper circuit membrane and the lower circuit membrane, and the upper circuit membrane and the spacer layer being removed at the contact portion of the membrane switch layer;

a balance bar, comprising a connecting section passing through the through hole of the linking portion; and at least one buffer layer, being formed to cover at least the whole of a lower surface of the contact portion and extending along the first lateral path and the second lateral path;

wherein when the keycap moves up and down, the connecting section of the balance bar is disposed on the contact portion of the membrane switch layer and rotatably slides between the first lateral path and the second lateral path.

8. The keyswitch of claim 7, wherein the at least one buffer layer has a buffer layer gap less than a through-hole width of the through hole.

9. The keyswitch of claim 7, wherein the through hole also communicates with an extension hole formed on a plane of the base plate, the extension hole is perpendicular to the through hole, and the extension hole extends in the normal direction of the through hole.

10. The keyswitch of claim 9, wherein the first lateral path and the second lateral path are respectively located on the two sides of the extension hole.

11. The keyswitch of claim 9, wherein the at least one buffer layer surrounds the extension hole.

12. The keyswitch of claim 9, wherein a respective first lengths of the first lateral path and a respective second length of the second lateral path both correspond to a third length of the extension hole.

13. The keyswitch of claim 7, wherein a first friction coefficient of the contact portion is less than a second friction coefficient of the at least one buffer layer.

14. The keyswitch of claim 7, wherein a membrane elasticity coefficient of the contact portion is less than a buffer elasticity coefficient of the at least one buffer layer.

* * * * *